United States Patent [19]

Rausing

[11] Patent Number: 4,811,849

[45] Date of Patent: Mar. 14, 1989

[54] PACKING CONTAINERS AND BLANKS THEREFOR

[75] Inventor: Hans Rausing, Wadhurst Park, England

[73] Assignee: AB Tetra Pak, Lund, Sweden

[21] Appl. No.: 191,777

[22] Filed: May 5, 1988

Related U.S. Application Data

[63] Continuation of Ser. No. 19,175, Feb. 26, 1987, abandoned.

[30] Foreign Application Priority Data

Mar. 24, 1986 [GB] United Kingdom ..... 8607242

[51] Int. Cl.[4] ..... B65D 5/54

[52] U.S. Cl. ..... 206/621.2; 206/621.1; 229/125.42

[58] Field of Search ..... 206/607, 620, 621, 621.1, 206/621.2, 631.3; 229/125.42, 7 R, 17 R, 17 G

[56] References Cited

U.S. PATENT DOCUMENTS

| | | | |
|---|---|---|---|
| 3,116,002 | 12/1963 | Crawford et al. | 229/17 R |
| 4,327,838 | 5/1982 | Kuchenbecker | 206/621 |
| 4,450,581 | 5/1984 | Hirata | 383/42 |
| 4,546,884 | 10/1985 | Kuchenbecker | 229/17 R |

FOREIGN PATENT DOCUMENTS

| | | | |
|---|---|---|---|
| 315243 | 9/1969 | Sweden | 229/17 G |
| 1008353 | 10/1965 | United Kingdom . | |
| 1046424 | 10/1966 | United Kingdom | 229/17 R |
| 2078901 | 8/1967 | United Kingdom . | |

*Primary Examiner*—Stephen Marcus
*Assistant Examiner*—Gary E. Elkins
*Attorney, Agent, or Firm*—Burns, Doane, Swecker & Mathis

[57] ABSTRACT

A packing container of the ridge roof type of the kind which is adapted to be opened by folding out again a bellows fold (B) formed at the top closure of the container in order to form an emptying opening (16) in the shape of a pouring spout. With the object of making the container liquid-tight and at the same time easy to open perforation (15) is arranged above the said bellows fold (B) below which the sealing fin (10) delaminates when the container is opened. The seal between the material layers forming the sealing fin (10) below this perforation is considerably weaker or almost negligible compared with the seal between material layers above the tearing perforation.

15 Claims, 3 Drawing Sheets

PACKING CONTAINERS AND BLANKS THEREFOR

This application is a continuation of application Ser. No. 019,175, filed Feb. 26, 1987, now abandoned.

FIELD OF THE INVENTION

The present invention relates generally to packing containers and more particularly, to packing containers of the ridge roof type (so-called gable-top package).

BACKGROUND OF THE INVENTION

Packages of this kind are typically manufactured from a plane, substantially rectangular blank of a cardboard material or a comparably rigid but foldable material which is provided with a suitable crease line pattern and is formed to a tube, one end of which is given a bottom closure of any chosen kind and the other end of which is closed by means of so-called bellows folding with a sealing fin arranged on top of it formed of the edge zone of the packing container, that is to say a top closure which below the sealing fin consisting of the edge zone comprises four rectangular end panels, of which two are preferably placed obliquely to each other whilst each of the other two is divided into three triangular panels and folded in under the sealing fin to form so-called bellows folds, the sealing fin consisting, at least to the greater part, of four material layers which are joined to one another by means of a sealing operation.

In packing containers of the aforementioned type it has been a problem to make them tight and at the same time openable. It has been found impossible up to now to fulfill both these requirements in a satisfactory manner and it has been more or less unavoidable to sacrifice the tightness of the container in favour of making it easily openable.

There is a need therefore, to eliminate the said problem of the known packing containers and make available a packing container which is both easily openable and at the same time satisfactorily tight.

OBJECTS AND SUMMARY OF THE INVENTION

The present invention provides a packing container having wall portions which are folded and sealed together to form an end closure for the container comprising a fin, wherein the fin is provided with a line of weakening running longitudinally therealong and the wall portions forming the fin are sealed to one another substantially more strongly above the line of weakening than immediately below the line of weakening.

The invention includes a blank for folding and sealing to form a container, which blank has at one end a transverse running strip for folding and sealing to form a fin, within which strip is provided a line of weakness running along the strip, wherein a seal inhibiting composition is provided on said strip on the container interior side of the line of weakness.

The invention further includes a web of such blanks.

Preferably, in the sealing fin above one of the said bellows folds, a tearing indication weakening the materials layers is provided along a line between, and preferably parallel with, the top line and the foot of the sealing fin, and the seal between the material layers below this tearing indication is made substantially weaker or almost negligible compared with the seal between the material layers above the tearing indication.

BRIEF DESCRIPTION OF THE DRAWINGS

The invention will be described in more detail in the following with reference to the attached drawings which by way of example show an embodiment of a packing container in accordance with the same.

DETAILED DESCRIPTION OF A PREFERRED EMBODIMENT

Figure 1A:
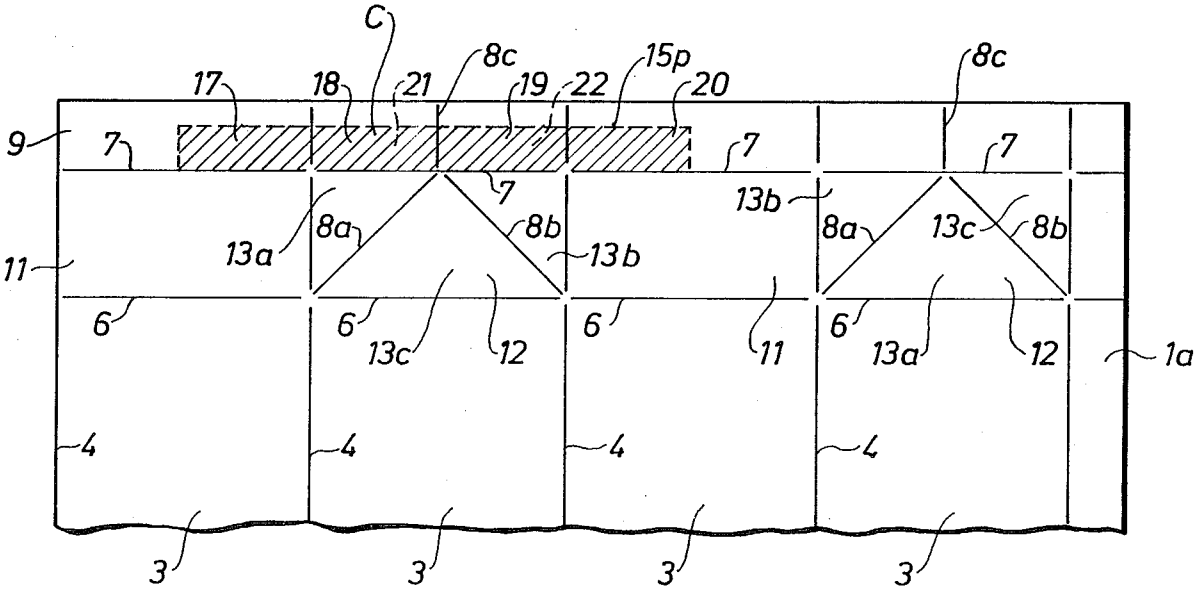
FIG. 1*a* is a plan view of a part of a plane rectangular blank which is intended to form the top of a packing container.
Figure 1B:
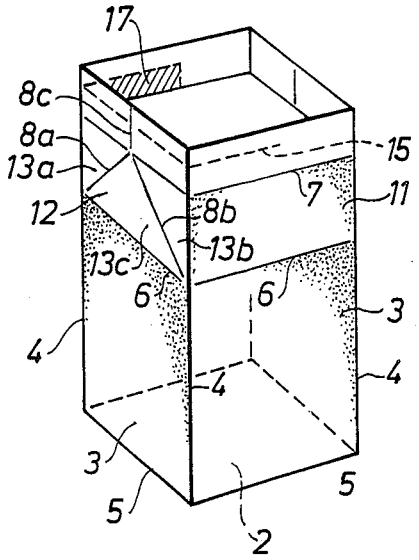
FIG. 1*b* is a perspective view of raised but not yet closed packing container manufactured from the blank shown in FIG. 1*a;*

The packing container shown in FIG. 1*b* is made from a substantially rectangular blank of a cardboard material or a comparable rigid, but foldable material coated with plastics on both sides. The crease line and tearing indication pattern is evident from FIG. 1*a* which thus shows the part of the blank which is intended to form the top part of the packing container. After the blank has been provided with the crease line pattern, as shown in FIG. 1*a,* it is formed into a tube (FIG. 1*b*) by sealing together its two longitudinal edges in, for example, a so-called overlap joint. In FIG. 1*a* the overlap lug required for the formulation of the overlap joint is designated 1*a.* One end of the tube formed is given an optional kind of bottom closure which, however, is of no vital importance for the invention and is not shown, therefore, in greater detail.

The tubular part of the packing container consists of four side walls 3 which are delimited by side edge lines 4, the bottom edge lines 4 and upper boundary lines 6. The upper end of the blank, and hence of the tube, has been provided beside the crease lines 6 with crease lines 7 running parallel with these and further crease lines 8*a, b* and *c* which form two letters Ys turned upside down. As a result, the upper end of the packing container can be closed by means of a so-called bellows folding with a sealing fin 10 arranged above it, formed of the upper edge zone 9 of the packing container (FIG. 1*c*), that is to say a closure which below the sealing fin consisting of the edge zone comprises four rectangular end panels 11,11,12 and 12 of which two panels 11 are placed obliquely and the panels 12 are divided into three triangular, smaller panels 13*a, b* and *c* folded in under the sealing fin 10 to form so-called bellows folds (one of which is shown at B in FIG. 1*c*). The sealing fin consequently will comprise, at least in its greater part, four material layers which are joined to one another by means of a sealing operation to form the configuration shown in FIG. 1*c.* In case both sides of the blank are coated with a plastics layer, e.g. polyethylene, this seal can be brought about, for example, by heat sealing which means that the material layers in the sealing fin 10 of the finished folded packing container are pressed against each other with the help of heating sealing jaws in a packing machine of the conventional type, as a result of which the plastic coatings on the heated sealing surfaces facing each other are fused together to form a liquid-tight seal.

In accordance with the present invention a tearing indication 15 weakening the material layers is arranged above the bellows fold B formed along a line between, and preferably parallel with, the top line 10*a* and the foot line 10*b* of the sealing fin 10. The tearing indication 15 is formed in accordance with FIG. 1*a* by a perforation 15*p* whose length on the example chosen substantially corresponds to the length of two whole package widths. On closing the packing container by means of bellows folding, symmetrical in relation to a crease line 8*c*, the different portions of the perforation 15*p* are made to adjoin each other, so that the tearing indication 15 will extend from the front edge 10*c* of the fin 10 substantially to the centre of the fin (FIG. 1*c*).

The perforation 15 preferably can be arranged in the central cardboard layer before the same is coated with plastics layers and possibly with other layers such as e.g. aluminium foil. The advantage gained from such a procedure is that the packing material will be liquid-tight, since the perforation holes or perforation slots included will be covered by a plastics layer.

Figure 1C:
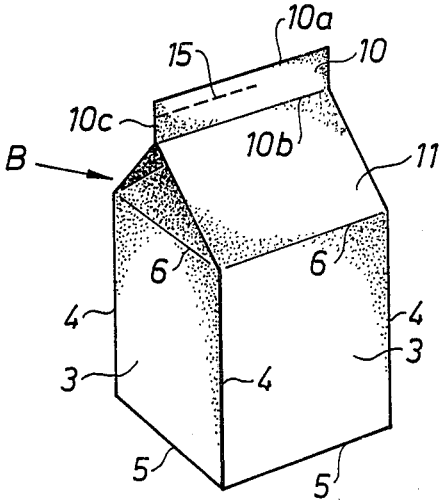
FIG. 1*c* is a perspective view of the closed top of the packing container.
Figure 1D:
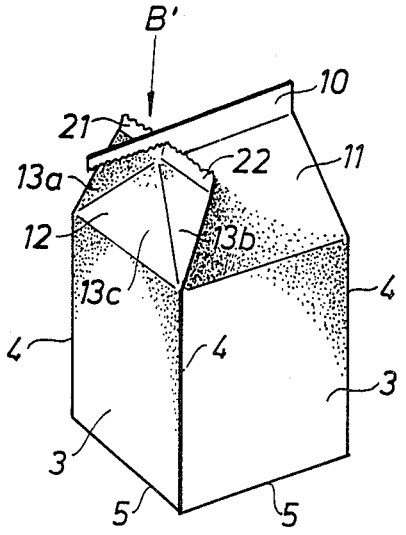
FIG. 1*d* is a perspective view of the packing container during an opening stage.
Figure 1E:
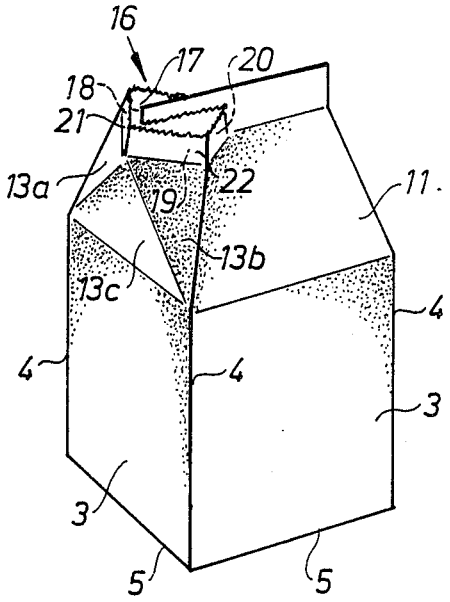
FIG. 1*e* is a perspective view of the container fully opened.

The packing container shown in FIG. 1*c* is opened by means of folding out again the bellows fold B so as to form an emptying opening 16 in the shape of a pouring spout which is shown in FIG. 1*e*. The procedure here is that one pushes one's finger into the openable bellows fold B and breaks the package outwards towards the sides, as a result of which the perforation 15 is broken up and the sealing fin 10 in the region below the tearing perforation 15 is delaminated, whereas the corresponding region above this perforation remains non-delaminated to attain the condition shown in FIG. 1*d*. Subsequently the parts of the sealing fin 10 so delaminated are pressed together, as a result of which seals between these parts are broken and the bellows fold B bulges outwards so as to form the emptying opening 16 in the shape of a pouring spout shown in FIG. 1*e*.

With a view to facilitating the breaking up of the seal between the inside surfaces 17–20 adjoining one another of the bellows fold B folded flat (FIG. 1*d*) and thereby facilitating the subsequent bulging out of this bellows fold, these adjoining surfaces are reduced in their sealing capacity in accordance with the invention by a pretreatment of the corresponding portions on the packing blank shown in FIG. 1*a*. These pretreated parts correspond to the hatched region C in FIG. 1*a* and comprise the part of the edge zone 9 which is located between the tearing perforation 15*p* or 15 and the upper crease line 7 and are marked 17 to 20 in the figures shown. This seal-reducing pretreatment may involve, for example, the covering of the plastics layer with a coating inhibiting or weakening a seal (a so-called abhesive) consisting of some siliceous compound, e.g. polysiloxane rubber or a wax material of a type known in itself.

In accordance with the invention it is preferred to reduce the seal of all adjoining surfaces below the tearing perforation 15 in the sealing fin 10, that is to say, not only the inside surfaces (17–20) on the part of the sealing fin 10 forming the emptying opening 16 but also the two outside surfaces 21,22 of the rectangular end panel 12 above the fold-out bellows fold B. As a result of this, on opening the packing container, the folding out of the bellows fold to the plane condition shown in FIG. 1*b*, is facilitated.

While this invention has been illustrated and described in accordance with a preferred embodiment, it is recognized that variations and changes may be made and equivalents employed herein without departing from the invention as set forth in the claims.

Through the combination of the tearing perforation 15 arranged in the sealing fin 10 and the said weakening of the seal of the inside surfaces 17–20 sealed in a detachable manner in the region C below the tearing perforation a packing container is obtained in accordance with the present invention which eliminates the conflicting requirements mentioned earlier with regard to easy openability and at the same time reliable liquid-tightness and which instead makes both these requirements well compatible with each other.

What is claimed is:

1. In a packing container of the type which is manufactured from a plane, substantially rectangular blank of a substantially rigid but foldable and tearable material, said blank including a crease line pattern, an edge zone along one side thereof, and four rectangular end panels adjacent said edge zone, said blank being formed into a tube having two ends, a first of said two ends having a bottom closure and a second of said two ends being closed by a bellow folding including a sealing fin, said sealing fin being formed from said edge zone, two of said four rectangular end panels being placed obliquely to each other and another two of said panels each being divided into three triangular panels and folded inwardly of said tube to form said bellow folding, four material layers of said blank being joined to one another in said sealing fin, the improvement comprising said sealing fin including a top line adjacent said one side thereof and a footline adjacent said bellow folding and a tearing indication is provided in said sealing fin along a line between and parallel to said top line and said footline to weaken the material layers along said tearing indication, a first seal being formed between the material layers between said tearing indication and said footline and a second seal being formed between the material layers between said tearing indication and said top line, said first seal immediately adjacent the tearing indication being substantially weaker than said second seal immediately adjacent the tearing indication so that said tearing indication defines a boundary line between strongly sealed material layers and weakly sealed material layers.

2. A packing container in accordance with claim 1, wherein said first seal is made weaker than said second seal by coating said first region with a seal-reducing agent.

3. A packing container having a substantially rectangular transverse cross-section and including wall portions which are folded and sealed together to form an end closure for the container including a fin having an edge, a line of weakening being provided in said fin and extending longitudinally therealong, said wall portions including first and second pairs of opposed top sides, said first pair of opposed top sides being brought together and said second pair of opposed top sides being folded inwardly and caught between said first pair of opposed top sides to form said fin, sealing means being provided for sealing said first and second pairs of opposed top sides together, and sealing inhibiting means being provided for inhibiting sealing between said first and second pairs of opposed top sides in a first region thereof, said line of weakening defining a boundary line between said first region where sealing is inhibited and a second region between the line of weakening and the edge of the fin where sealing is provided.

4. A packing container in accordance with claim 3, wherein said wall portions include first and second pairs of opposed rectangular panels, said first pair of opposed panels being leaned obliquely against one another and each panel of said second pair of opposed panels being divided into three triangular panel sections and folded inwardly between said first pair of opposing panels, said first and second pairs of top sides being provided adjacent said first and second pairs of panels.

5. A packing container in accordance with claim 4, wherein the seal between all contacting surfaces of the top sides is reduced below said line of weakening in the fin.

6. A packing container in accordance with claim 3, wherein the sealing inhibiting means includes a coating on said wall portions which includes a seal reducing agent.

7. A packing container in accordance with claim 3, wherein said line of weakness is a line of perforation extending through a part only of the container wall thickness, the remaining thickness being liquid tight.

8. A packing container in accordance with claim 3, wherein said line of weakening consists of a perforation provided in the fin in the form of through-holes or slots covered by a liquid-tight plastics layer.

9. A container blank comprising:

a transverse running strip extending along an edge of said blank, said running strip including a crease line permitting the running strip to be foldable to form a fin;

a line of weakening within said running strip which extends along said strip and which defines a boundary line between first and second regions of said running strip, said first region being defined at a side of said boundary line opposite the edge of the blank; and a seal inhibiting composition provided on said strip only in said first region.

10. A blank in accordance with claim 9, wherein said blank is divided by fold lines into panels and further comprises four substantially rectangular side wall forming panels, four substantially rectangular end closure forming panels, two non-adjacent ones of which are each subdivided into three triangular panel sections, and four substantially rectangular strip forming panels.

11. A blank in accordance with claim 10, wherein said line of weakness runs through one whole strip forming panel and extends approximately half way along two strip forming panels adjacent said one strip forming panel.

12. A blank in accordance with claim 11, wherein the seal inhibiting composition occupies an area bounded by the line of weakness and a border between the strip forming panels and the end closure forming panels on a face of the blank adapted to be an interior face of the formed container.

13. A blank in accordance with claim 9, wherein the seal inhibiting composition is also present on a face of the blank adapted to be an exterior face of the formed container in a region contained within said one whole strip forming panel bounded by the line of weakness and the border between the strip forming panel and the adjacent end closure forming panel.

14. A web of packing material comprising a succession of blanks as claimed in claim 9, wherein each of said blanks is connected to the blanks adjacent thereto.

15. A packing container in accordance with claim 10, wherein a surface of two of said strip forming panels adjacent said subdivided end closure forming panels is folded back on itself and sealed, and wherein said seal inhibiting composition is provided on said surface to a side of said line of weakening opposite the edge of said blank.

* * * * *